US006206115B1

(12) United States Patent
Overstreet et al.

(10) Patent No.: US 6,206,115 B1
(45) Date of Patent: Mar. 27, 2001

(54) STEEL TOOTH BIT WITH EXTRA-THICK HARDFACING

(75) Inventors: James L. Overstreet, Webster; Ronald L. Jones, Cleveland; Jeremy K. Morgan, Conroe; Trevor M. McAninch, Montgomery, all of TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/138,239

(22) Filed: Aug. 21, 1998

(51) Int. Cl.[7] ..... E21B 10/50
(52) U.S. Cl. ..... 175/374; 76/108.2
(58) Field of Search ..... 175/374, 375; 148/319; 76/79, 108.2, DIG. 2

(56) References Cited

U.S. PATENT DOCUMENTS

| | | | | |
|---|---|---|---|---|
| 1,547,842 | | 7/1925 | Stoody et al. . | |
| 1,676,887 | | 7/1928 | Chamberlin . | |
| 2,846,193 | | 8/1958 | Chadderdon . | |
| 2,867,137 | | 1/1959 | Joy . | |
| 4,372,404 | | 2/1983 | Drake . | |
| 4,499,795 | * | 2/1985 | Radtke | 76/108.2 |
| 4,705,124 | | 11/1987 | Abrahamson et al. . | |
| 4,726,432 | * | 2/1988 | Scott et al. | 76/108.2 |
| 5,152,194 | * | 10/1992 | Keshavan et al. | 76/108.2 |
| 5,351,771 | | 10/1994 | Zahradnik . | |
| 5,445,231 | * | 8/1995 | Scott et al. | 175/374 |
| 5,492,186 | * | 2/1996 | Overstreet et al. | 175/374 |
| 5,663,512 | | 9/1997 | Schader et al. . | |
| 5,816,347 | | 10/1998 | Dennis et al. . | |
| 5,862,873 | | 1/1999 | Matthias et al. . | |
| 5,868,213 | * | 2/1999 | Cisneros et al. | 175/428 |

* cited by examiner

*Primary Examiner*—William Neuder
(74) *Attorney, Agent, or Firm*—Bracewell & Patterson; James E. Bradley

(57) ABSTRACT

An earth-boring bit has a bit body with at least one earth disintegrating cutter mounted on it. The cutter is generally conically shaped and rotatably secured to the body. The cutter has a plurality of teeth formed on it. The teeth have underlying stubs of steel which are integrally formed with and protrude from the cutter. The stubs have flanks which incline toward each other and terminate in a top. A carburized layer is formed on the flanks and the top to a selected depth. The stub has a width across its top from one flank to the other that is less than twice the depth of the carburized layer. A layer of hardfacing is coated on the tops and flanks of the stub, forming an apex for the tooth.

12 Claims, 2 Drawing Sheets

STEEL TOOTH BIT WITH EXTRA-THICK HARDFACING

TECHNICAL FIELD

This invention relates to improvement to earthboring tools, especially to steel tooth bits that use hardfacing containing carbide particles to enhance wear resistance.

BACKGROUND ART

The earliest rolling cutter earth boring bits had teeth machined integrally from steel, conically shaped, earth disintegrating cutters. These bits, commonly known as "steel-tooth" or "mill-tooth" bits, are typically used for penetrating relatively soft geological formations of the earth. The strength and fracture-toughness of steel teeth permits the effective use of relatively long teeth, which enables the aggressive gouging and scraping action that is advantageous for rapid penetration of soft formations with low compressive strengths.

However, it is rare that geological formations consist entirely of soft material with low compressive strength. Often, there are streaks of hard, abrasive materials that a steel tooth bit should penetrate economically without damage to the bit. Although steel teeth possess good strength, abrasion resistance is inadequate to permit continued rapid penetration of hard or abrasive streaks.

Consequently, it has been common in the art since at least the early 1930s to provide a layer of wear resistant metallurgical material called "hardfacing" over those portions of the teeth exposed to the severest wear. The hardfacing typically consists of extremely hard particles, such as sintered, cast or macrocrystalline tungsten carbide dispersed in a steel, cobalt or nickel alloy binder or matrix. Such hardfacing materials are applied by heating with a torch a tube of the particles which welds to the surface to be hardfaced a homogeneous dispersion of hard particles in the matrix. After hardfacing, the cone is preferably heat treated, which typically includes carburizing and quenching from a high temperature to harden the cone. The particles are much harder than the matrix but more brittle. After hardening, the matrix has a hardness preferably in the range from 53 to 68 Rockwell C (RC). The mixture of hard particles with a softer but tougher steel matrix is a synergistic combination that produces a good hardfacing.

There have been a variety of different hardfacing materials and patterns, including special tooth configurations, to improve wear resistance or provide self sharpening. Generally, the hardfacing applied to the teeth of new bits is in a preapplication ratio range of 50 to 80 percent carbide particles, typically about 70 percent, in a metal matrix of iron, nickel, cobalt or their alloys. The thickness of the hardfacing deposit on new bits is usually about 1/16 to 1/8 inch over the flanks, end portions and top of the crest of the tooth. Portions of the hardfacing may be somewhat thicker. The thicker portions are generally at the corners where the flanks intersect the crest. These thicker portions may be up to double that of other areas.

Worn bits have been retipped by adding a type of hardfacing to the teeth after they have been worn. Often a substantial part of the original hardfacing would be worn off along with a portion of the underlying steel teeth. The retipping hardfacing materials typically used are about 35–50% by weight of carbide particles with a fairly soft copper, bronze, brass or iron matrix. The soft matrix allows the retipper to shape the new tooth being formed. Depending on the extent of wear, the hardfacing may be quite thick, even greater than 3/16 inch on top of the top of the underlying steel tooth. Retippers normally do not heat treat the retipped bit. Because of the softer matrix and the lack of heat treating the hardness of the matrix after application on a retipped tooth would normally be considerably less than a new bit tooth. While satisfactory for very soft drilling, such as water well drilling, the retipped hardfacing is not as wear resistant as the original equipment hardfacings described above, which contain a higher percentage of carbide particles and a harder matrix metal.

While hardfacing provides good wear resistance for a steel tooth bit, teeth are still susceptible to breakage. Breakage is generally thought to occur due to portions of the teeth being too brittle. Brittleness, particularly in smaller diameter drill bits, is at least partially caused by the underlying carburized layer. The standard manufacturing procedure is to carburize the steel cone after it is hardfaced to harden the surface for resisting erosion. The carburizing is performed in a furnace, using either a gas or a pack process. This process adds carbon throughout the hardfacing, and also increases the carbon content in a carburized layer near the surface of the steel, the layer having a depth of about 0.030 to 0.140 inch depending upon bit size and application. The carburizing process creates a carburized layer even below the hardfacing.

If the tooth crest is fairly sharp as in smaller cones, the carburized layer becomes deeper at the crest of the tooth because the carburized layers on the two flanks and sharp crest tend to merge. This makes the crest brittle. Even though subsequently carburized, this brittle area can be subject to premature tooth failure.

DISCLOSURE OF INVENTION

In this invention, the underlying steel tooth or stub is formed with a shorter length than conventional. The flanks of the tooth stub will be sufficiently far from each other at the crest or top of the tooth stub to prevent the carburized layers on the flanks and crest from merging. Therefore there is no increase in carburized layer depth at the crest, unlike the prior art teeth with sharp crests. The distance from one flank to the other, measured perpendicular to the axis of the tooth at the crest, is greater than twice the depth of the carburized layers on the flanks.

A layer of hardfacing is applied to the top and flanks of the tooth stub, forming an apex for the tooth. The layer of hardfacing is much thicker than normally used, preferably equal to or greater than 3/16 inch on the crest. The hardfacing layer has an axial depth that is preferably at least 15 percent the axial length of the tooth stub.

DESCRIPTION OF THE PREFERRED EMBODIMENT

Figure 1:
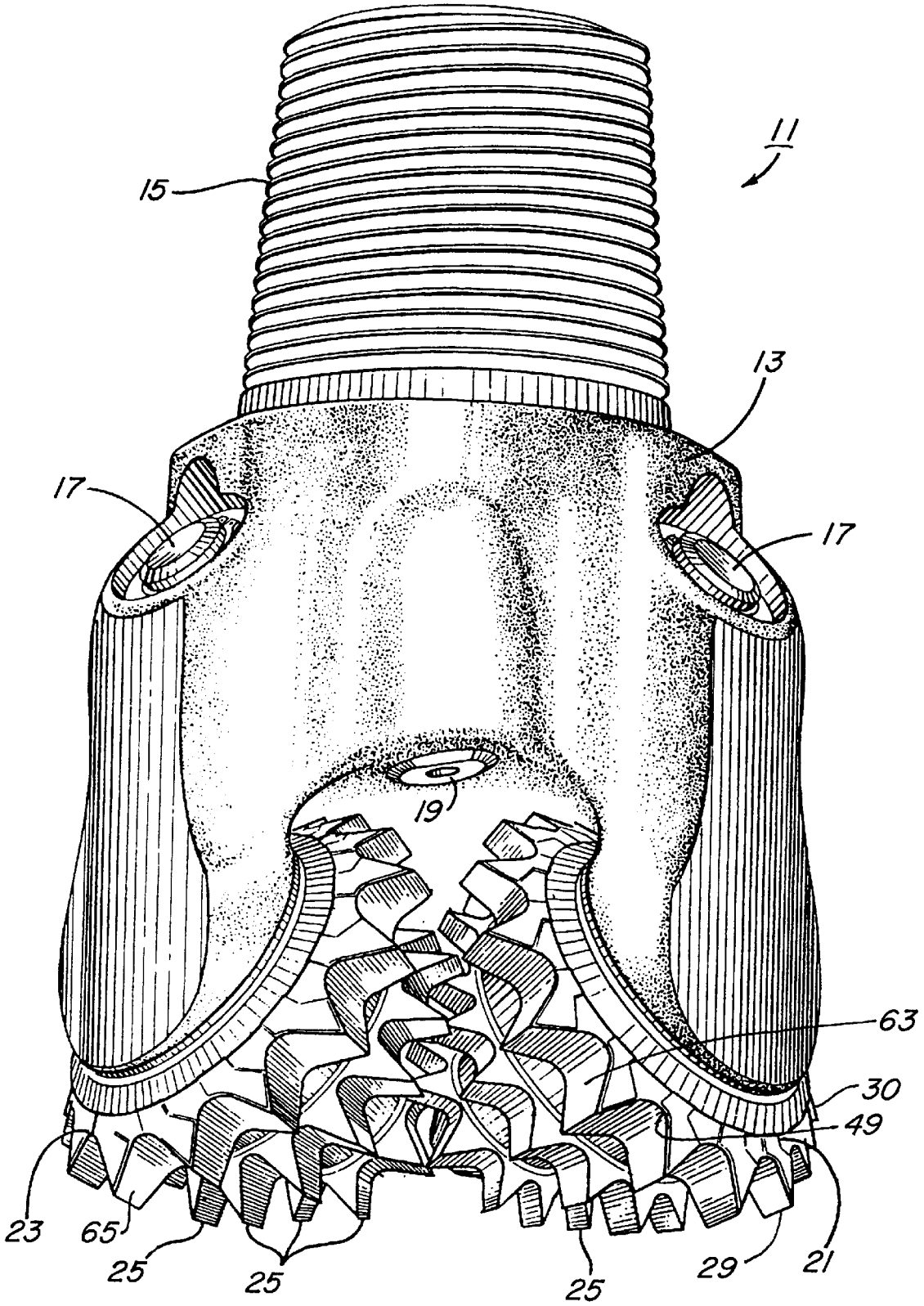
FIG. 1 is a perspective view of an earth-boring bit of the steel tooth type constructed in accordance of this invention.

Referring to FIG. 1, an earth-boring bit 11, modified in accordance with the present invention, is depicted. Earthboring bit 11 includes a bit body 13 having threads 15 at its upper extent for connecting bit 11 into a drill string (not shown). Each leg of bit 11 is provided with a lubricant compensator 17. At least one nozzle 19 is provided in bit body 13 for directing pressurized drilling fluid from within the drill string and bit against the bottom of the borehole.

The cutters 21, 23, generally three (one of which is obscured from view in FIG. 1), are rotatably secured to respective legs of bit body 13. A plurality of inner row teeth 25 are arranged in generally circumferential rows on cutters 21, 23, being integrally formed on the cutters, usually by machining. Heel row teeth 29 are located at the outer edges of each cutter 21, 23 adjacent gage surface 30.

Figure 2:
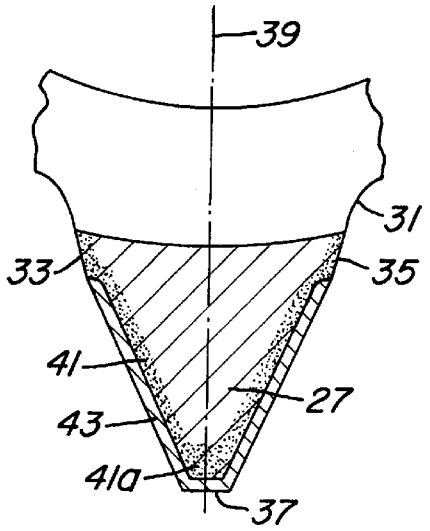
FIG. 2 is a sectional view of a tooth of an earth-boring bit as in FIG. 1, but showing a prior art design.

FIG. 2 illustrates a tooth 27 which in the prior art would be in a heel row in place of heel row teeth 29 (FIG. 1) in the cutter 21 of FIG. 1. Prior art tooth 27 is formed with a milling cutter which forms a root 31, inclined flanks 33, 35 and an elongated crest 37. One of the flanks 33, 35 is a leading flank and the other a trailing flank, considering the direction of rotation of cutter 21.

Figure 4:
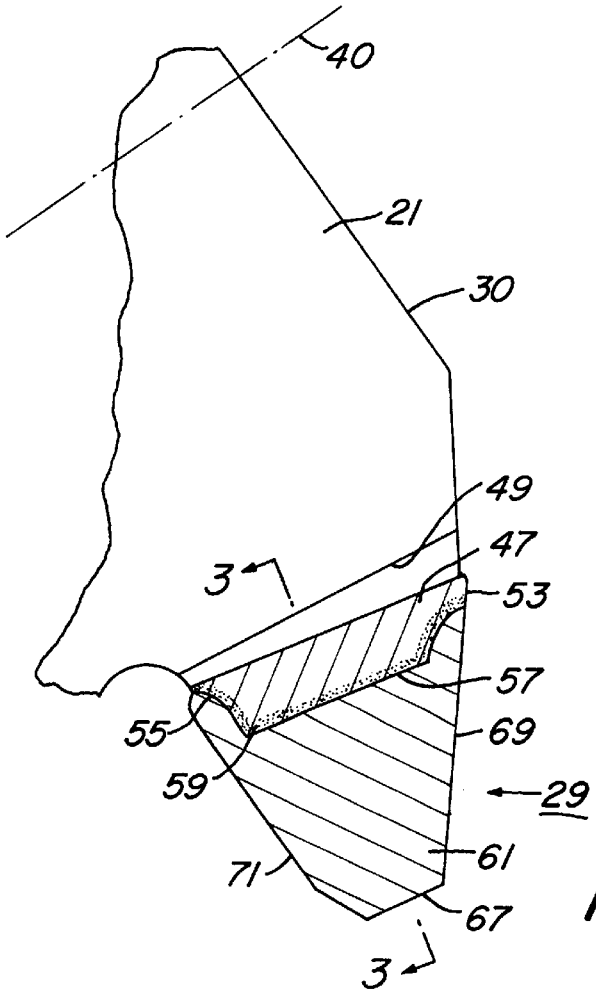
FIG. 4 is a sectional view of the tooth of FIG. 3, taken along the line 4—4 of FIG. 3.

Tooth 27 has an axis 39 which is substantially perpendicular to the cutter axis 40 of rotation (FIG. 4). A carburized layer 41 is formed in the underlying steel of tooth 27 in a conventional process. Carburized layer 41 is generally in the depth range from about 0.030 to 0.140 inch depending upon bit size and application. The depth of carburizing layer 41 is not uniform because of the sharpness of crest 37. Because of the short distance from one flank 33 to the other flank 35 at crest 37, a deeper area 41*a* of carburizing layer 41 will result at crest 37. Carburized portion 41*a* becomes deeper because of the merging of the carburized layers 41 underlying flanks 33, 35. The distance from flank 33 to flank 35, measured perpendicular to axis 39 at crest 37, is less than twice the average depth of carburized layer 41 on flanks 33, 35.

A layer of hardfacing 43 is applied over tooth 27. It may be of various types, typically containing tungsten carbide granules in an alloy steel matrix. The thickness of hardfacing 43 on flanks 33, 35 and on top of crest 37 is about 1/16 to 1/8 inch. Heat treating, which includes carburizing, is usually performed after hardfacing. In another type of prior art tooth, shown in U.S. Pat. No. 5,351,771, curved recesses are located at the junctions of the flanks with the crest. If tooth 27 had those recesses, the thickness of hardfacing 43 would be about double in the recesses than on the top of crest 37 and on flanks 33, 35. In another type of prior art tooth, a slot is located on the leading flank as in U.S. Pat. No. 5,445,231. If tooth 27 had such a slot, the thickness of hardfacing 43 on the flank over the slot would be about double that of the rest of tooth 27.

Figure 3:
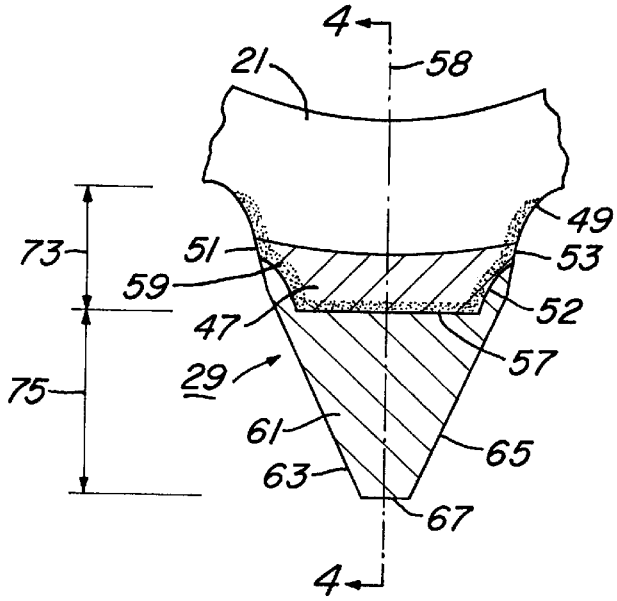
FIG. 3 is a sectional view, taken along the line 3—3 of FIG. 4, of a tooth constructed in accordance of this invention.

FIG. 3 shows a heel row tooth 29 constructed in accordance with this invention. Tooth 29 has a steel stub 47 which is integrally formed with cutter 21 in a conventional manner by milling. Stub 47 is shorter than the steel portion of tooth 27 of the prior art. Stub 47 extends upward from roots 49, has flanks 51, 52 that incline toward each other, and outer and inner ends 53, 55. Roots 49 are the valleys between teeth 29, as shown in FIG. 1. During rotation about cutter axis 40 (FIG. 4), one flank 51, 52 leads while the other trails. Flanks 51, 52 join outer and inner ends 53,55, terminating in a top or crest 57. Top 57 is shown to be flat and perpendicular to tooth axis 58, but could be of other configurations.

Stub 47 has a carburizing layer 59 that is uniform and of a depth of about 0.080 to 0.120 inch. Carburized layer 59 is formed conventionally after hardfacing. Carburized layer 59 does not have an increased depth layer at the top 57. The distance between flanks 51, 52, measured perpendicular to tooth axis 58 at the junction with top 57, is substantially greater than twice the depth of carburized layer 59. The carburized layers 59 on flanks 51, 52 do not merge with each other at top 57.

A hardfacing layer 61 is applied to tooth stub 47 in a conventional manner. Hardfacing 61 may be of a variety of types, but preferably includes tungsten carbide granules or particles in an alloy steel matrix. The matrix binder may contain iron, nickel, cobalt and their alloys and has a hardness after application on tooth stub 47 and heat treating in the range from about 53 to 68 RC. The tungsten carbide particles are in a pre-application ratio in a hardfacing tube of about 50 to 80 percent by weight, preferably about 70 percent. Because of its extra thickness on top 57, hardfacing 61 will be applied in multiple passes, but without allowing the earlier passes to cool substantially. After hardfacing 61 is applied, cutter 21 is heat treated in a conventional manner. The heat treating process creates the carburized layer 59 and also enhances the hardfacing 61.

Hardfacing 61 is shaped generally to form an extension or apex of stub 47 to resemble the configuration of prior art tooth 27. The apex of hardfacing 61 includes flanks 63, 65 which extend generally in the same direction from flanks 51, 52, respectively, terminating in a crest 67. The apex of hardfacing 61 also has outer and inner end portions 69, 71 which extend in the same direction from tooth stub outer and inner end portions 53, 55, respectively. Hardfacing 61 also may have a thinner portion, typically about 0.047 to 0.125 inch, that will cover a portion of tooth stub flanks 51, 52 and outer and inner ends 53, 55.

Flanks 63, 65 of hardfacing 61 converge to a fairly sharp crest 67. The overall length of tooth 29 from root 49 to crest 67, measured along tooth axis 58, is conventional. However, the thickness 75 of hardfacing 61 measured from top 57 of stub 47 to crest 67 is much greater than previously utilized with this type of hardfacing, being at least 3/16 inch. Thickness 75 will normally be twice or more the thickness of hardfacing 61 covering tooth stub flanks 51, 52 and outer and inner ends 53, 55. In the embodiment shown, tooth stub 47 has a shorter axial length 73, measured along axis 58 from root 49 to top 57, than axial thickness 75 of hardfacing 67. However, tooth stub length 73 could be longer than hardfacing thickness 75. Tooth stub length 73 should not be so long so as to decrease the distance between tooth stub flanks 51, 52 to a point where their carburized layers 59 merge and become extra deep. For a very large diameter bit having long teeth, the minimum axial thickness 75 of 3/16 inch of hardfacing 61 will be not less than 15 percent the axial length 73 of tooth stub 58. For smaller diameter bits, 8¼ inch or less, the minimum axial thickness 75 of 3/16 inch divided by axial length 73 will normally be higher, at least 35 percent.

The invention has significant advantages. Utilizing an extra-thick hardfacing layer reduces the width of the underlying steel crest from flank-to-flank. This blunter underlying or tooth stub top avoids extra-deep carburizing layers at the top of the tooth stub. A shorter tooth stub and a thicker hardfacing layer on top can reduce brittleness and the possibility of breakage without reducing overall tooth length.

While the invention has been shown in one of its forms, it should be susceptible to various changes without departing from the scope of the invention. For example, although shown only on a heel row tooth, the hardfacing in accordance with this invention could also be applied to inner row teeth and various tooth geometries.

We claim:

1. An earth-boring bit comprising:

a bit body;

at least one earth disintegrating cutter, the cutter being generally conically shaped and rotatably secured to the bit body;

a plurality of teeth formed on the cutter, at least one tooth of the teeth comprising:

a steel stub integrally formed with and protruding from the cutter, the stub having a pair of flanks which incline toward each other relative to an axis of the tooth and terminate in a top;

a carburized layer formed on the flanks and the top to a selected depth, the depth of the carburized layer being substantially uniform on all surfaces of the stub;

the distance between the flanks, measured perpendicular to the axis at the top, being greater than twice the depth of the carburized layer;

a layer of tube hardfacing coated on the top and flanks of the stub and forming an apex for the tooth; and wherein the hardfacing has a thickness measured along the axis of the tooth from the top of the stub to the apex formed by the hardfacing which is at least 3/16 inch.

2. An earth-boring bit comprising:

a bit body;

at least one earth disintegrating cutter, the cutter being generally conically shaped and rotatably secured to the bit body;

a plurality of teeth formed on the cutter, at least one tooth of the teeth comprising:

a steel stub integrally formed with and protruding from the cutter, the stub having a pair of flanks which incline toward each other relative to an axis of the tooth and terminate in a top;

a carburized layer formed on the flanks and the top to a selected depth, the depth of the carburized layer being substantially uniform on all surfaces of the stub;

the distance between the flanks, measured perpendicular to the axis at the top, being greater than twice the depth of the carburized layer;

a layer of tube hardfacing coated on the top and flanks of the stub and forming an apex for the tooth; and wherein the stub has a length measured along the axis of the tooth from a root of the tooth to the top, and wherein the hardfacing has a thickness measured along the axis of the tooth from the top of the stub to the apex formed by the hardfacing, which is at least 15 percent of the length of the stub, the thickness of the hardfacing being at least 3/16 inch.

3. An earth-boring bit comprising:

a bit body;

at least one earth disintegrating cutter, the cutter being generally conically shaped and rotatably secured to the bit body;

a plurality of teeth formed on the cutter, at least one tooth of the teeth comprising:

a steel stub integrally formed with and protruding from the cutter;

a layer of tube hardfacing coated on the stub, forming an apex for the tooth, the hardfacing having carbide particles within a metal matrix, the matrix having a hardness after application of the hardfacing on the tooth and heat treating of at least 53 RC; and a carburized layer formed on the top of the stub; and wherein the hardfacing has a thickness measured along the axis of the tooth from the top of the stub to the apex formed by the hardfacing which is at least 3/16 inch.

4. The bit according to claim 3, wherein the stub has flanks on opposite sides which incline toward each other relative to the axis, and inner and outer end surfaces, the flanks and the inner and outer end surfaces terminating at the top.

5. The bit according to claim 3, wherein:

the stub has flanks on opposite sides which incline toward each other relative to the axis, and inner and outer end surfaces, the flanks and the inner and outer end surfaces terminating at the top; and the hardfacing is coated on the flanks to a thickness which is substantially no greater than one-half the thickness of the hardfacing on the top.

6. The bit according to claim 3, wherein:

the stub has flanks on opposite sides which incline toward each other relative to the axis, and inner and outer end surfaces, the flanks and the inner and outer end surfaces terminating at the top; and the distance between the flanks measured perpendicular to the axis at a junction with the top is greater than twice the depth of the carburized layer.

7. The bit according to claim 3, wherein:

the depth of the carburized layer is substantially uniform on all surfaces of the stub, including the top.

8. The bit according to claim 3, wherein the stub has a length measured along the axis of the tooth from a root of the stub to the top, and wherein the thickness of the hardfacing at the top of the stub is at least 15 percent the length of the stub.

9. The bit according to claim 3 wherein in a pre-application ratio, the carbide particles comprise at least 50 percent by weight of the hardfacing.

10. An earth-boring bit comprising:

a bit body;

at least one earth disintegrating cutter, the cutter being generally conically shaped and rotatably secured to the bit body;

a plurality of teeth formed on the cutter, at least one tooth of the teeth comprising:

a steel stub integrally formed with and protruding from the cutter for a length measured along an axis of the tooth from a root of the tooth to a top of the stub, the stub having leading and trailing flanks on opposite sides which incline toward each other relative to the axis, and inner and outer end surfaces, the flanks and the inner and outer end surfaces terminating at the top;

a layer of tube hardfacing coated on the stub, forming an apex for the tooth, the hardfacing having carbide particles within a metal matrix, the matrix having a hardness after application of the hardfacing on the tooth and hardfacing of at least 53 RC; and wherein the hardfacing has a thickness measured along the axis of the tooth from the top of the stub to the apex formed by the hardfacing which is at least 3/16 inch.

11. The bit according to claim 10, wherein the stub has a carburized layer on its top, flanks and end surfaces; and wherein the depth of the carburized layer is substantially the same on the top, flanks and end surfaces.

12. The bit according to claim 11, wherein:

the distance from one of the flanks to the other of the flanks measured perpendicular to the axis is at least twice the depth of the carburized layer.

* * * * *